US008576164B2

(12) United States Patent
Sprague et al.

(10) Patent No.: US 8,576,164 B2
(45) Date of Patent: Nov. 5, 2013

(54) SPATIALLY COMBINED WAVEFORMS FOR ELECTROPHORETIC DISPLAYS

(75) Inventors: Robert A. Sprague, Saratoga, CA (US); Craig Lin, San Jose, CA (US); Tin Pham, San Jose, CA (US); Ping-Yueh Cheng, Taoyuan (TW)

(73) Assignee: Sipix Imaging, Inc., Fremont, CA (US)

( * ) Notice: Subject to any disclaimer, the term of this patent is extended or adjusted under 35 U.S.C. 154(b) by 451 days.

(21) Appl. No.: 12/909,752

(22) Filed: Oct. 21, 2010

(65) Prior Publication Data

US 2011/0096104 A1 Apr. 28, 2011

Related U.S. Application Data

(60) Provisional application No. 61/255,028, filed on Oct. 26, 2009.

(51) Int. Cl.
*G09G 3/34* (2006.01)

(52) U.S. Cl.
USPC ..... 345/107; 345/690; 345/694; 359/296

(58) Field of Classification Search
USPC ..... 345/107, 204–215; 359/296
See application file for complete search history.

(56) References Cited

U.S. PATENT DOCUMENTS

| | | | | |
|---|---|---|---|---|
| 4,143,947 | A | 3/1979 | Aftergut et al. | |
| 4,259,694 | A * | 3/1981 | Liao | 358/3.07 |
| 4,443,108 | A | 4/1984 | Webster | |
| 5,266,937 | A | 11/1993 | DiSanto et al. | |
| 5,754,584 | A | 5/1998 | Durrant et al. | |
| 5,831,697 | A | 11/1998 | Evanicky et al. | |
| 5,923,315 | A | 7/1999 | Ueda et al. | |
| 6,005,890 | A | 12/1999 | Clow et al. | |
| 6,045,756 | A | 4/2000 | Carr et al. | |
| 6,069,971 | A | 5/2000 | Kanno et al. | |
| 6,111,248 | A | 8/2000 | Melendez et al. | |
| 6,154,309 | A | 11/2000 | Otani et al. | |
| 6,504,524 | B1 * | 1/2003 | Gates et al. | 345/107 |
| 6,532,008 | B1 | 3/2003 | Guranlnick | |
| 6,639,580 | B1 | 10/2003 | Kishi et al. | |
| 6,657,612 | B2 | 12/2003 | Machida et al. | |

(Continued)

FOREIGN PATENT DOCUMENTS

| | | |
|---|---|---|
| WO | WO 2005/004099 | 1/2005 |
| WO | WO 2005/031688 | 4/2005 |

(Continued)

OTHER PUBLICATIONS

Kao, Wen-Chung et al., "Configurable Timing Controller Design for Active Matrix Electrophoretic Display," Feb. 2009, IEEE Transactions on Consumer Electronics, vol. 55, pp. 1-5.*

(Continued)

*Primary Examiner* — Alexander Eisen
*Assistant Examiner* — Sanjiv D Patel
(74) *Attorney, Agent, or Firm* — Perkins Coie LLP

(57) ABSTRACT

The present invention is directed to a driving method for compensating the response speed change of an electrophoretic display due to temperature variation, photo-degradation or aging of the display device, without a complex structure (e.g., use of sensors). This is accomplished by combining two waveforms, one of which causes the grey level to become dimmer and the other waveform causes the grey level to become brighter, as the response speed degrades.

14 Claims, 8 Drawing Sheets

(56) References Cited

U.S. PATENT DOCUMENTS

| | | | | |
|---|---|---|---|---|
| 6,671,081 | B2 | 12/2003 | Kawai | |
| 6,674,561 | B2 | 1/2004 | Ohnishi et al. | |
| 6,686,953 | B1 | 2/2004 | Holmes | |
| 6,796,698 | B2 | 9/2004 | Sommers et al. | |
| 6,903,716 | B2 | 6/2005 | Kawabe et al. | |
| 6,914,713 | B2 | 7/2005 | Chung et al. | |
| 6,970,155 | B2 | 11/2005 | Cabrera | |
| 6,995,550 | B2 | 2/2006 | Jacobson et al. | |
| 7,046,228 | B2 | 5/2006 | Liang et al. | |
| 7,177,066 | B2 | 2/2007 | Chung et al. | |
| 7,242,514 | B2 | 7/2007 | Chung et al. | |
| 7,283,119 | B2 | 10/2007 | Kishi | |
| 7,349,146 | B1 | 3/2008 | Douglass et al. | |
| 7,504,050 | B2 | 3/2009 | Weng et al. | |
| 7,733,311 | B2 | 6/2010 | Amundson et al. | |
| 7,800,580 | B2 | 9/2010 | Johnson et al. | |
| 7,839,381 | B2 | 11/2010 | Zhou et al. | |
| 7,952,558 | B2 | 5/2011 | Yang et al. | |
| 7,999,787 | B2 | 8/2011 | Amundson et al. | |
| 8,035,611 | B2 | 10/2011 | Sakamoto | |
| 8,044,927 | B2 | 10/2011 | Inoue | |
| 8,054,253 | B2 | 11/2011 | Yoo | |
| 2002/0021483 | A1 | 2/2002 | Katase | |
| 2002/0033792 | A1 | 3/2002 | Inoue | |
| 2003/0095090 | A1 | 5/2003 | Ham | |
| 2003/0137521 | A1 | 7/2003 | Zehner et al. | |
| 2004/0227746 | A1 | 11/2004 | Shih | |
| 2004/0246562 | A1 | 12/2004 | Chung et al. | |
| 2004/0263450 | A1 | 12/2004 | Lee et al. | |
| 2005/0001812 | A1 | 1/2005 | Amundson et al. | |
| 2005/0146775 | A1* | 7/2005 | Chung et al. | 359/296 |
| 2005/0162377 | A1 | 7/2005 | Zhou et al. | |
| 2005/0179642 | A1 | 8/2005 | Wilcox et al. | |
| 2005/0185003 | A1 | 8/2005 | Dedene et al. | |
| 2005/0210405 | A1 | 9/2005 | Ernst et al. | |
| 2005/0219184 | A1 | 10/2005 | Zehner et al. | |
| 2006/0050361 | A1 | 3/2006 | Johnson | |
| 2006/0132426 | A1 | 6/2006 | Johnson | |
| 2006/0139305 | A1 | 6/2006 | Zhou et al. | |
| 2006/0139309 | A1 | 6/2006 | Miyasaka | |
| 2006/0164405 | A1 | 7/2006 | Zhou | |
| 2006/0187186 | A1 | 8/2006 | Zhou et al. | |
| 2006/0192751 | A1* | 8/2006 | Miyasaka et al. | 345/107 |
| 2006/0262147 | A1 | 11/2006 | Kimpe et al. | |
| 2007/0035510 | A1 | 2/2007 | Zhou et al. | |
| 2007/0046621 | A1 | 3/2007 | Suwabe et al. | |
| 2007/0046625 | A1 | 3/2007 | Yee | |
| 2007/0052668 | A1 | 3/2007 | Zhou et al. | |
| 2007/0070032 | A1 | 3/2007 | Chung et al. | |
| 2007/0080926 | A1 | 4/2007 | Zhou et al. | |
| 2007/0080928 | A1 | 4/2007 | Ishii et al. | |
| 2007/0103427 | A1 | 5/2007 | Zhou et al. | |
| 2007/0109274 | A1 | 5/2007 | Reynolds | |
| 2007/0132687 | A1 | 6/2007 | Johnson | |
| 2007/0146306 | A1 | 6/2007 | Johnson et al. | |
| 2007/0159682 | A1 | 7/2007 | Tanaka et al. | |
| 2007/0182402 | A1 | 8/2007 | Kojima | |
| 2007/0188439 | A1 | 8/2007 | Kimura et al. | |
| 2007/0200874 | A1 | 8/2007 | Amundson et al. | |
| 2007/0247417 | A1 | 10/2007 | Miyazaki et al. | |
| 2007/0262949 | A1 | 11/2007 | Zhou et al. | |
| 2007/0276615 | A1 | 11/2007 | Cao et al. | |
| 2007/0296690 | A1 | 12/2007 | Nagasaki | |
| 2008/0150886 | A1 | 6/2008 | Johnson et al. | |
| 2008/0211833 | A1 | 9/2008 | Inoue | |
| 2008/0303780 | A1 | 12/2008 | Sprague et al. | |
| 2009/0096745 | A1* | 4/2009 | Sprague et al. | 345/107 |
| 2009/0267970 | A1 | 10/2009 | Wong et al. | |
| 2010/0134538 | A1 | 6/2010 | Sprague et al. | |
| 2010/0194733 | A1 | 8/2010 | Lin et al. | |
| 2010/0194789 | A1 | 8/2010 | Lin et al. | |
| 2010/0238203 | A1* | 9/2010 | Stroemer et al. | 345/690 |
| 2010/0283804 | A1 | 11/2010 | Sprague et al. | |
| 2010/0295880 | A1 | 11/2010 | Sprague et al. | |
| 2011/0096104 | A1 | 4/2011 | Sprague et al. | |
| 2012/0120122 | A1 | 5/2012 | Lin et al. | |
| 2012/0274671 | A1 | 11/2012 | Sprague et al. | |
| 2012/0320017 | A1 | 12/2012 | Sprague et al. | |

FOREIGN PATENT DOCUMENTS

| | | |
|---|---|---|
| WO | WO 2005/034076 | 4/2005 |
| WO | WO 2009/049204 | 4/2009 |
| WO | WO 2010/132272 | 11/2010 |

OTHER PUBLICATIONS

U.S. Appl. No. 12/046,197, filed Mar. 2008, Wang et al.
U.S. Appl. No. 12/115,513, filed May 5, 2008, Sprague et al.
U.S. Appl. No. 61/295,628, filed Jan. 15, 2010, Lin et al.
U.S. Appl. No. 61/296,832, filed Jan. 20, 2010, Lin.
U.S. Appl. No. 61/311,693, filed Mar. 8, 2010, Chan et al.
U.S. Appl. No. 61/351,764, filed Jun. 4, 2010, Lin.
Kao, WC., Ye, JA., Chu, MI., and Su, CY. (Feb. 2009) Image Quality Improvement for Electrophoretic Displays by Combining Contrast Enhancement and Halftoning Techniques. *IEEE Transactions on Consumer Electronics*, 2009, vol. 55, Issue 1, pp. 15-.
Kao, WC., (Feb. 2009) Configurable Timing Controller Design for Active Matrix Electrophoretic Dispaly. *IEEE Transactions on Consumer Electronics*, 2009, vol. 55, Issue 1, pp. 1-5.
Kao, WC., Ye, JA., and Lin, C. (Jan. 2009) Image Quality Improvement for Electrophoretic Displays by Combining Contrast Enhancement and Halftoning Techniques. *ICCE 2009 Digest of Technical Papers*, 11.2-2.
Kao, WC., Ye, JA., Lin, FS., Lin, C., and Sprague, R. (Jan. 2009) Configurable Timing Controller Design for Active Matrix Electrophoretic Display with 16 Gray Levels. *ICCE 2009 Digest of Technical Papers*, 10.2-2.
Kao, WC., Fang, CY., Chen, YY., Shen, MH., and Wong, J. (Jan. 2008) Integrating Flexible Electrophoretic Display and One-Time Password Generator in Smart Cards. *ICCE 2008 Digest of Technical Papers*, p. 4-3. (Int'l Conference on Consumer Electronics, Jan. 9-13, 2008).
Sprague, R.A. (May 18, 2011) *Active Matrix Displays for e-Readers Using Microcup Electrophoretics*. Presentation conducted at SID 2011, 49 Int'l Symposium, Seminar and Exhibition, May 15-May 20, 2011, Los Angeles Convention Center, Los Angeles, CA, USA.

* cited by examiner

| | | | | | | | |
|---|---|---|---|---|---|---|---|
| 1 | 2 | 1 | 2 | 1 | 2 | 1 | 2 |
| 2 | 1 | 2 | 1 | 2 | 1 | 2 | 1 |
| 1 | 2 | 1 | 2 | 1 | 2 | 1 | 2 |
| 2 | 1 | 2 | 1 | 2 | 1 | 2 | 1 |
| 1 | 2 | 1 | 2 | 1 | 2 | 1 | 2 |
| 2 | 1 | 2 | 1 | 2 | 1 | 2 | 1 |
| 1 | 2 | 1 | 2 | 1 | 2 | 1 | 2 |
| 2 | 1 | 2 | 1 | 2 | 1 | 2 | 1 |

Figure 6

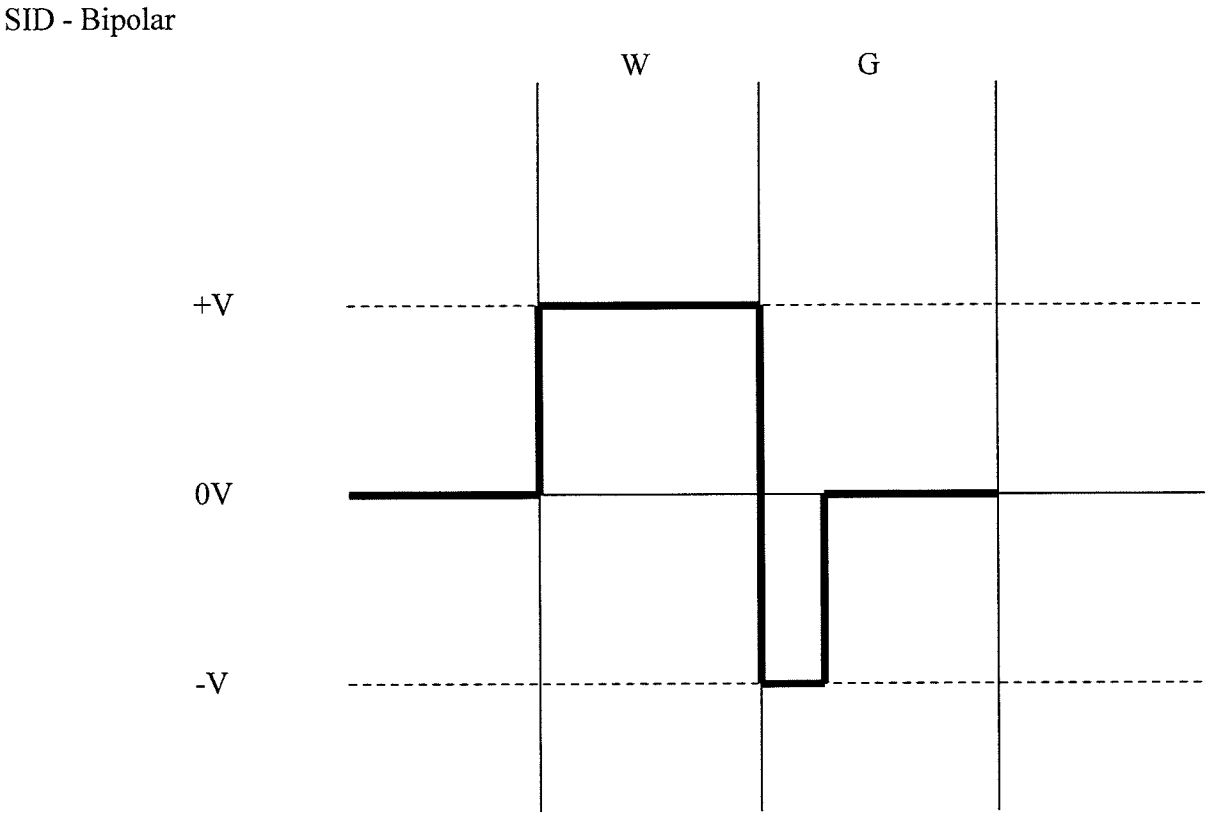
Figure 7a: WG Waveform Bipolar

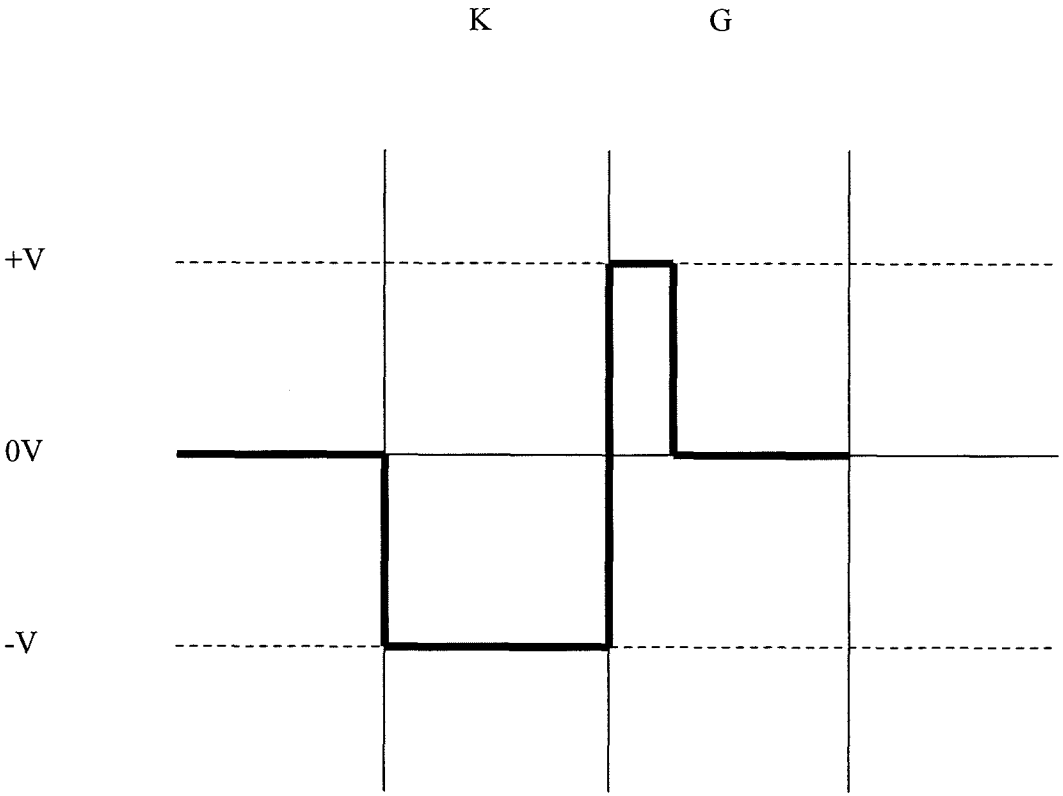
Figure 7b: KG Waveform Bipolar

SPATIALLY COMBINED WAVEFORMS FOR ELECTROPHORETIC DISPLAYS

This application claims priority to U.S. Provisional Application No. 61/255,028, filed Oct. 26, 2009; the content of which is incorporated herein by reference in its entirety.

FIELD OF THE INVENTION

An electrophoretic display is a device based on the electrophoresis phenomenon of charged pigment particles dispersed in a solvent. The display usually comprises two electrode plates placed opposite of each other and a display medium comprising charged pigment particles dispersed in a solvent is sandwiched between the two electrode plates. When a voltage difference is imposed between the two electrode plates, the charged pigment particles may migrate to one side or the other, depending on the polarity of the voltage difference, to cause either the color of the pigment particles or the color of the solvent to be seen from the viewing side of the display.

One of the factors which determine the performance of an electrophoretic display is the optical response speed of the display, which is a reflection of how fast the charged pigment particles move (towards or away from the viewing side), in response to a driving voltage.

However, the optical response speed of a display device may not remain constant because of temperature variation, batch variation, photo-exposure or, in some cases, due to aging of the display medium. As a result, when driving waveforms with fixed durations are applied, the performance of the display (e.g., grey level) may not remain the same because the optical response speed of the display medium has changed. To overcome this problem, adjustment of the driving waveforms needs to be made to account for the changes in the response speed.

In addition, if the medium ages with photo-exposure or is in a different temperature environment, the speed of the medium will change to cause the grey levels produced by waveforms of fixed lengths to shift. As a result, notable changes in color intensity and reflectance will be detected by the viewers.

One approach to compensate the speed change due to temperature variation is to use a temperature sensor to sense the ambient temperature and adjust the waveforms accordingly. However, the temperature sensor does not always accurately measure the temperature of the medium due to the thermal time constant. In addition, this approach is costly because more memory is needed for the additional look-up tables in the system.

For speed change caused by photo-degradation of the medium, a feedback sensor could be used to measure or predict the speed degradation. But such a system would add undesired complexity to the display device.

SUMMARY OF THE INVENTION

The present invention is directed to a driving method for compensating the response speed change of an electrophoretic display due to temperature variation, photo-degradation, difference in speed from batch to batch or aging of the display device, without a complex structure (e.g., use of sensors). This is accomplished by combining two waveforms, one of which causes the grey level to become dimmer and the other waveform causes the grey level to become brighter, as the response speed degrades or is different. The two waveforms are applied to two different groups of pixels. In one example, two groups of pixels may be arranged in a checker board manner. Since the pixels are finely interlaced, the viewers will see the average of every pair of pixels at the right grey level.

The first aspect of the invention is directed to a driving method for a display device having a binary color system comprising a first color and a second color, which method comprises a) applying waveform to drive each pixel in a first group of pixels from its initial color state to the full first color then to a color state of a desired level; and b) applying waveform to drive each pixel in a second group of pixels from its initial color state to the full second color then to a color state of a desired level.

In one embodiment, the first color and second colors are two contrasting colors. In one embodiment, the two contrasting colors are black and white. In one embodiment, the method uses mono-polar driving waveform. In one embodiment, the method uses bi-polar driving waveform. In one embodiment, the first and second groups of pixels are arranged in a random manner. In one embodiment, the first and second groups of pixels are arranged in a regular pattern. "Regular pattern," as used herein, refers to two groups of pixels arranged in a specific pattern, for example, a checker board pattern. In one embodiment, the first and second groups of pixels are arranged in a checker board fashion. In one embodiment, the first and second groups of pixels are determined based on the ratio of speed degradation of driving from the first color state to a desired color state versus the speed degradation of driving from the second color state to a desired color state. In one embodiment, the first and second groups of pixels are interchanged during updating of images. In one embodiment, the two waveforms are alternating between the two groups of pixels.

The second aspect of the invention is directed to a driving method for a display device having a binary color system comprising a first color and a second color, which method comprises a) applying waveform to drive each pixel in a first group of pixels from its initial color state to the full first color state, then to the full second color state and finally to a color state of a desired level; and b) applying waveform to drive each pixel in a second group of pixels from its initial color state to the full second color state, then to the full first color state and finally to a color state of a desired level.

In one embodiment, the first color is black and the second color is white or vice versa. In one embodiment, the first and second groups of pixels are interchanged during updating of images. In one embodiment, the two waveforms are alternating between the two groups of pixels.

BRIEF DISCUSSION OF THE DRAWINGS

FIG. 6 shows a checker board spatial arrangement of pixels.

FIGS. 7*a* and 7*b* show two bi-polar driving waveforms.

DETAILED DESCRIPTION OF THE INVENTION

Figure 1:
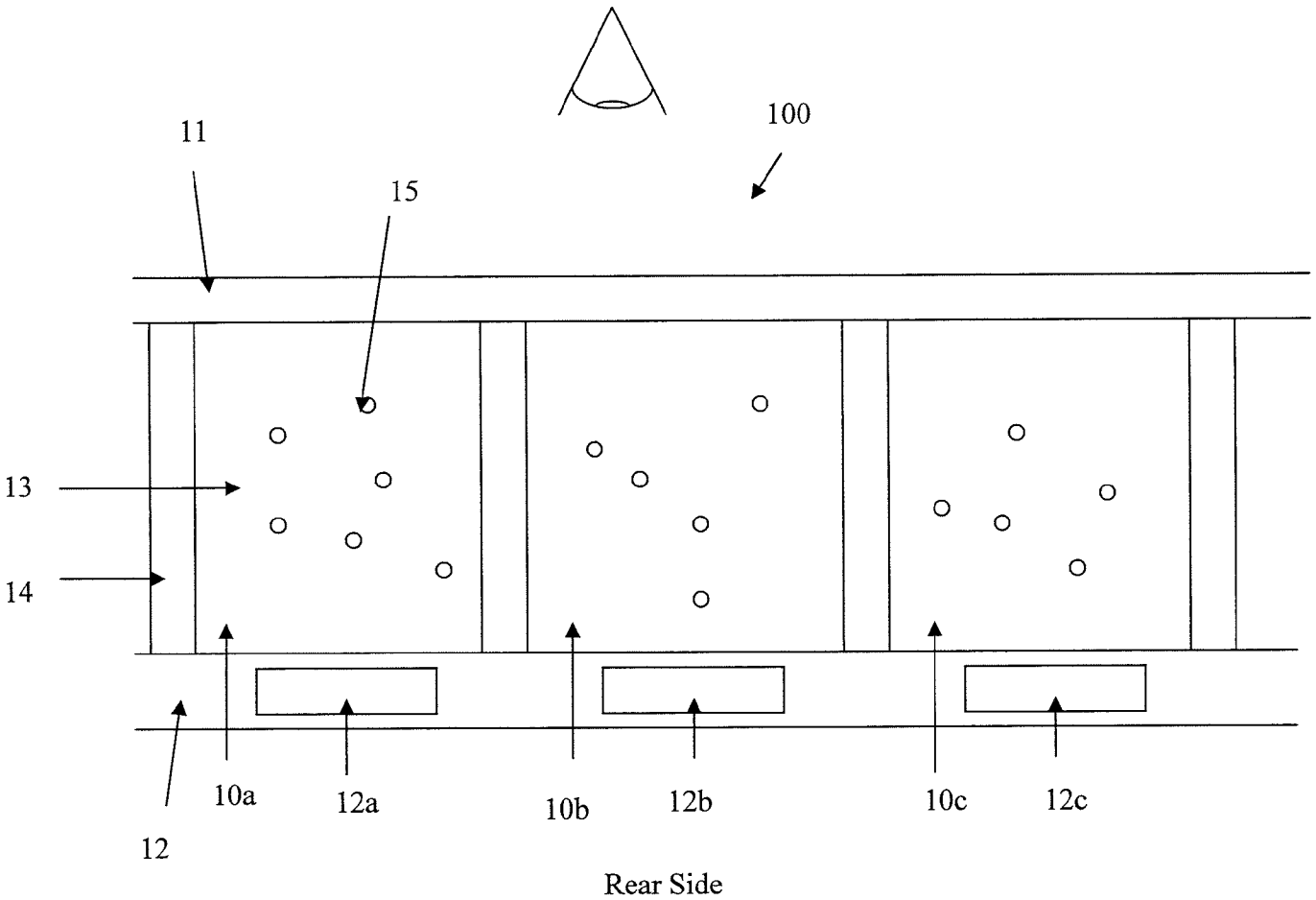
FIG. 1 depicts a typical electrophoretic display device.

FIG. 1 illustrates an electrophoretic display (100) which may be driven by any of the driving methods presented herein.

In FIG. 1, the electrophoretic display cells 10*a*, 10*b*, 10*c*, on the front viewing side indicated with a graphic eye, are provided with a common electrode 11 (which is usually transparent and therefore on the viewing side). On the opposing side (i.e., the rear side) of the electrophoretic display cells 10*a*, 10*b* and 10*c*, a substrate (12) includes discrete pixel electrodes 12*a*, 12*b* and 12*c*, respectively. Each of the pixel electrodes 12*a*, 12*b* and 12*c* defines an individual pixel of the electrophoretic display. However, in practice, a plurality of display cells (as a pixel) may be associated with one discrete pixel electrode.

It is also noted that the display device may be viewed from the rear side when the substrate 12 and the pixel electrodes are transparent.

An electrophoretic fluid 13 is filled in each of the electrophoretic display cells 10*a*, 10*b* and 10*c*. Each of the electrophoretic display cells 10*a*, 10*b* and 10*c* is surrounded by display cell walls 14.

The movement of the charged particles in a display cell is determined by the voltage potential difference applied to the common electrode and the pixel electrode associated with the display cell in which the charged particles are filled.

As an example, the charged particles 15 may be positively charged so that they will be drawn to a pixel electrode or the common electrode, whichever is at an opposite voltage potential from that of charged particles. If the same polarity is applied to the pixel electrode and the common electrode in a display cell, the positively charged pigment particles will then be drawn to the electrode which has a lower voltage potential.

The term "display cell" is intended to refer to a microcontainer which is individually filled with a display fluid. Examples of "display cell" include, but are not limited to, microcups, microcapsules, micro-channels, other partition-typed display cells and equivalents thereof.

In this application, the term "driving voltage" is used to refer to the voltage potential difference experienced by the charged particles in the area of a pixel. The driving voltage is the potential difference between the voltage applied to the common electrode and the voltage applied to the pixel electrode. As an example, in a binary system, positively charged white particles are dispersed in a black solvent. When zero voltage is applied to a common electrode and a voltage of +15V is applied to a pixel electrode, the "driving voltage" for the charged pigment particles in the area of the pixel would be +15V. In this case, the driving voltage would move the positively charged white particles to be near or at the common electrode and as a result, the white color is seen through the common electrode (i.e., the viewing side). Alternatively, when zero voltage is applied to a common electrode and a voltage of −15V is applied to a pixel electrode, the driving voltage in this case would be −15V and under such −15V driving voltage, the positively charged white particles would move to be at or near the pixel electrode, causing the color of the solvent (black) to be seen at the viewing side.

In another embodiment, the charged pigment particles 15 may be negatively charged.

In a further embodiment, the electrophoretic display fluid could also have a transparent or lightly colored solvent or solvent mixture and charged particles of two different colors carrying opposite charges, and/or having differing electrokinetic properties. For example, there may be white pigment particles which are positively charged and black pigment particles which are negatively charged and the two types of pigment particles are dispersed in a clear solvent or solvent mixture.

The charged particles 15 may be white. Also, as would be apparent to a person having ordinary skill in the art, the charged particles may be dark in color and are dispersed in an electrophoretic fluid 13 that is light in color to provide sufficient contrast to be visually discernable.

As stated, the electrophoretic display cells may be of a conventional walled or partition type, a microencapsulated type or a microcup type. In the microcup type, the electrophoretic display cells 10*a*, 10*b*, 10*c* may be sealed with a top sealing layer. There may also be an adhesive layer between the electrophoretic display cells 10*a*, 10*b*, 10*c* and the common electrode 11.

The term "binary color system" refers to a color system has two extreme color states (i.e., the first color and the second color) and a series of intermediate color states between the two extreme color states.

Figure 2:
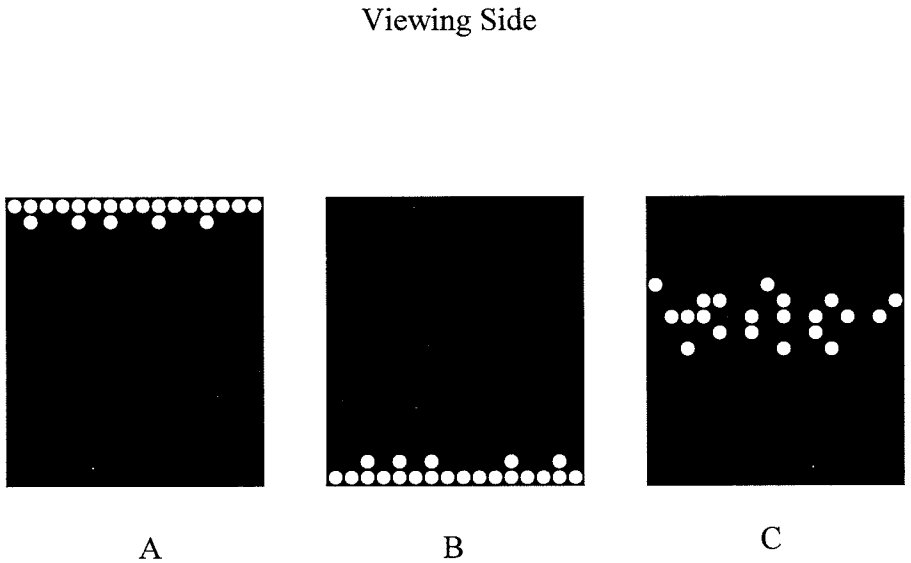
FIG. 2 illustrates an example of an electrophoretic display having a binary color system.

FIG. 2 is an example of a binary color system in which white particles are dispersed in a black-colored solvent.

In FIG. 2A, while the white particles are at the viewing side, the white color is seen.

In FIG. 2B, while the white particles are at the bottom of the display cell, the black color is seen.

In FIG. 2C, the white particles are scattered between the top and bottom of the display cell; an intermediate color is seen. In practice, the particles spread throughout the depth of the cell or are distributed with some at the top and some at the bottom. In this example, the color seen would be grey (i.e., an intermediate color).

While black and white colors are used in the application for illustration purpose, it is noted that the two colors can be any colors as long as they show sufficient visual contrast. Therefore the two colors in a binary color system may also be referred to as a first color and a second color.

The intermediate color is a color between the first and second colors. The intermediate color has different degrees of intensity, on a scale between two extremes, i.e., the first and second colors. Using the grey color as an example, it may have a grey scale of 8, 16, 64, 256 or more. In a grey scale of 8, grey level 0 may be a white color and grey level 7 may be a black color. Grey levels 1-6 are grey colors ranging from light to dark.

Figure 3:
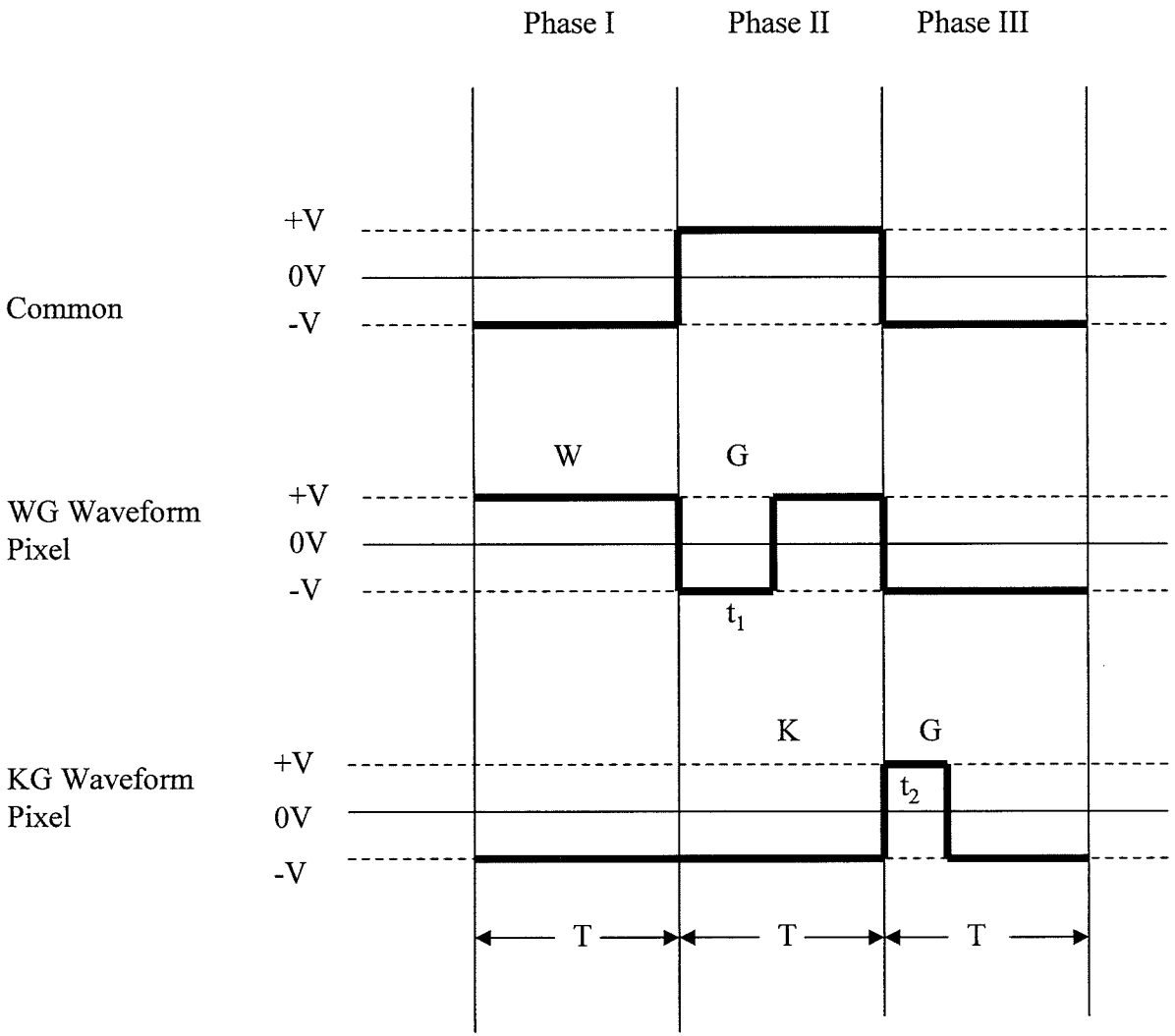
FIG. 3 shows two mono-polar driving waveforms.

FIG. 3 shows two driving waveforms WG and KG. As shown the waveforms have three driving phases (I, II and III). Each driving phase has a driving time of equal length, T, which is sufficiently long to drive a pixel to a full white or a full black state, regardless of the previous color state.

For brevity, in FIG. 3, each driving phase has the same length of T. However, in practice, the time taken to drive to the full color state of one color may not be the same as the time taken to drive to the full color state of another color.

For illustration purpose, FIG. 3 represents an electrophoretic fluid comprising positively charged white pigment particles dispersed in a black solvent.

The common electrode is applied a voltage of −V, +V and −V during Phase I, II and III, respectively.

For the WG waveform, during Phase I, the common electrode is applied a voltage of −V and the pixel electrode is applied a voltage of +V, resulting a driving voltage of +2V and as a result, the positively charged white pigment particles move to be near or at the common electrode, causing the pixel to be seen in a white color. During Phase II, a voltage of +V is applied to the common electrode and a voltage of −V is applied to the pixel electrode for a driving time duration of $t_1$. If the time duration $t_1$ is 0, the pixel would remain in the white state. If the time duration $t_1$ is T, the pixel would be driven to the full black state. If the time duration $t_1$ is between 0 and T, the pixel would be in a grey state and the longer $t_1$ is, the darker the grey color. After $t_1$ in Phase II and also in Phase III, the driving voltage for the pixel is shown to be 0V and as a result, the color of the pixel would remain in the same color state as that at the end of $t_1$ (i.e., white, black or grey). Therefore, the WG waveform is capable of driving a pixel from its initial color state to a full white (W) color state (in Phase I) and then to a black (K), white (W) or grey (G) state (in Phase II).

For the KG waveform, in Phase I, both the common and pixel electrodes are applied a voltage of −V, resulting in 0V driving voltage and as a result, the pixel remains in its initial color state. During Phase II, the common electrode is applied a voltage of +V while the pixel electrode is applied a voltage of −V, resulting in a −2V driving voltage, which drives the pixel to the black state. In Phase III, the common electrode is applied a voltage of −V and the pixel electrode is applied a voltage of +V for a driving time duration of $t_2$. If the time duration $t_2$ is 0, the pixel would remain in the black state. If the time duration $t_2$ is T, the pixel would be driven to the full white state. If the time duration $t_2$ is between 0 and T, the pixel would be in a grey state and the longer $t_1$ is, the lighter the grey color. After $t_2$ in Phase III, the driving voltage is 0V, thus allowing the pixel to remain in the same color state as that at the end of $t_2$. Therefore, the KG waveform is capable of driving a pixel from its initial color state, to a full black (K) state (in Phase II) and then to a black (K), white (W) or grey (G) state (in Phase III).

The term "full white" or "full black" state is intended to refer to a state where the white or black color has the highest intensity possible of that color for a particular display device. Likewise, a "full first color" or a "full second color" refers to a first or second color state at its highest color intensity possible.

Either one of the two waveforms (WG and KG) can be used to generate a grey level image as long as the lengths ($t_1$ or $t_2$) of the grey pulses are correctly chosen for the grey levels to be generated.

It is noted that varying durations of $t_1$ and $t_2$ in the WG and KG waveforms provide different levels of the grey color. In practice, $t_1$ in the WG waveform is fixed to achieve a particular grey level, and this also applies to $t_2$ in the KG waveform. But as the response speed becomes slower due to environmental conditions or aging of the display device, the fixed $t_1$ and $t_2$ in the waveforms would drive the display device to a grey level which is not the same as the originally intended grey level.

Figure 4:
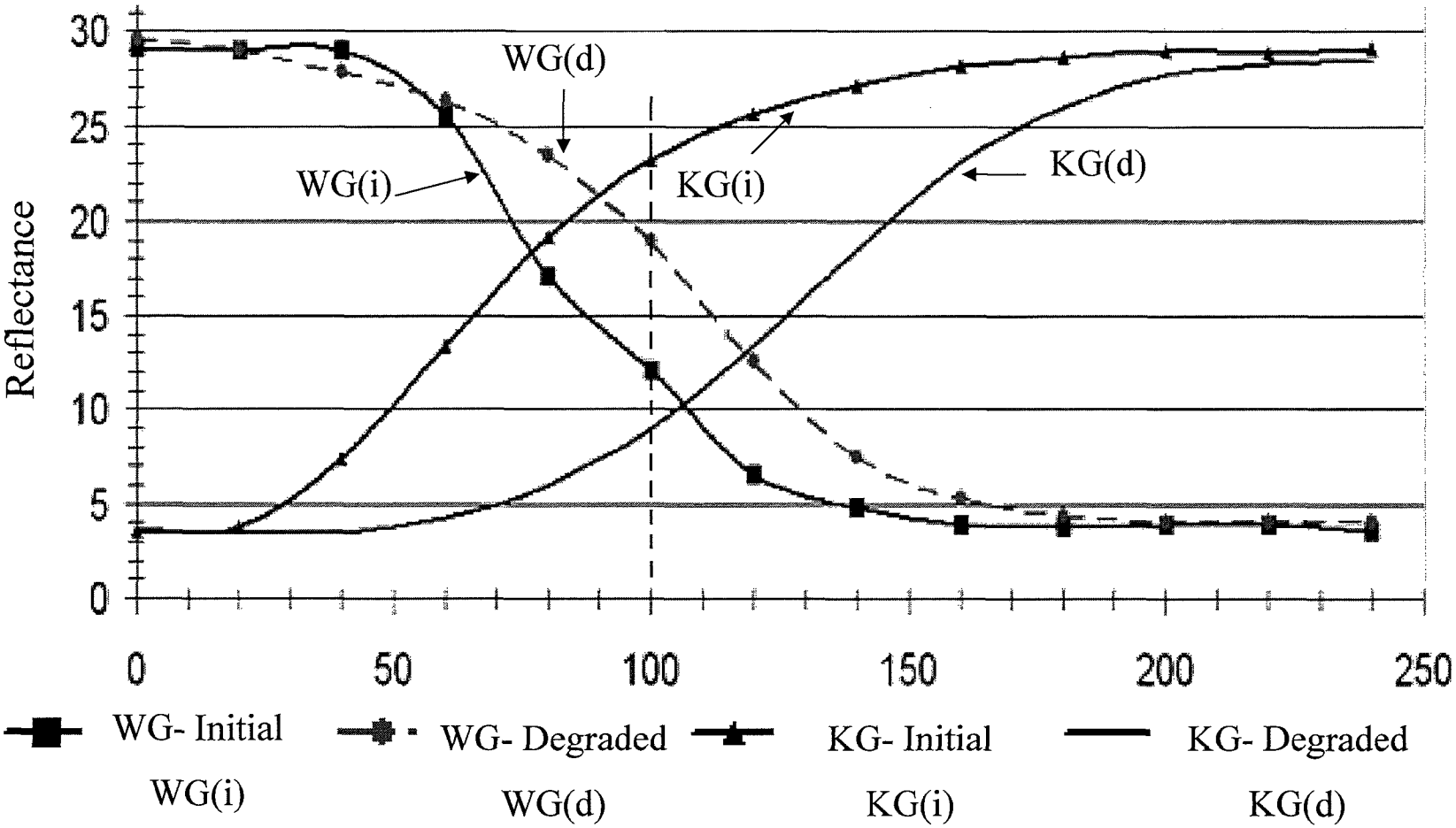
FIG. 4 shows how display medium decay may influence the reflectance/color intensity of the images displayed.

FIG. 4 is a graph which shows how the response speed degrades after time, for illustration purpose.

In the figure, for the WG waveform, line WG(i) is the initial curve of reflectance versus driving time and line WG(d) is the curve of reflectance versus driving time after degradation of the display medium. For the KG waveform, line KG(i) is the initial curve of reflectance versus driving time and line KG(d) is the curve after degradation.

As shown, after being driven by the same waveform WG, the grey levels showed a higher reflectance after the same length of the driving time, due to medium degradation. For example, after 100 msec of driving, the reflectance has increased from about 12 (WG(i)) to about 19 (WG(d)).

For the KG waveform, the grey levels showed a lower reflectance (23 for KG(i) vs. 9 for KG(d)) after the same length of the driving time, 100 msec, due to medium degradation.

It is also noted that the driving time from a full white state to a full black state by the WG waveform remains substantially the same (about 240 msec) for WG(i) and WG(d) and the degraded medium affects mainly the reflectance of the grey levels. This also applies to the KG waveform.

Previously, to compensate for this response speed change due to medium degradation, a sensor is needed to determine or predict the changes and the waveforms are then adjusted accordingly.

The present inventors have now found a driving method which can maintain the original color reflectance/intensity of images, without the use of a sensor.

The present invention is directed to a driving method for a display device having a binary color system comprising a first color and a second color, which method comprises a) applying waveform to drive each pixel in a first group of pixels from its initial color state to the full first color then to a color state of a desired level; and b) applying waveform to drive each pixel in a second group of pixels from its initial color state to the full second color then to a color state of a desired level.

The term "initial color state", throughout this application, is intended to refer to the first color state, the second color state or an intermediate color state of any level.

As an example, the method may utilize the combination of waveform WG and KG as shown in FIG. 3, and it is accomplished by driving a first group of pixels with the WG waveform and the second group of pixels with the KG waveform.

More specifically, in the first group, the pixels are driven from its initial color state to the full white state and then to black, white or different grey levels as desired and in the second group, the pixels are driven from its initial color state to the full black state and then to black, white or different grey levels as desired.

In other words, in the first group, some pixels are driven from their initial color states to the full white state and then to black, some from their initial color states to the full white state and remain white, some from their initial color states to the full white state and then to grey level 1, some from their initial color state to the full white state and then to grey level 2, and so on, depending on the images to be displayed.

In the second group, some pixels are driven from their initial color states to the full black state and then to white, some from their initial color states to the full black state and remain black, some from their initial color states to the full black state and then to grey level 1, some from their initial color states to the full black state and then to grey level 2, and so on, depending on the images to be displayed.

The term "a color state of a desired level" is intended to refer to either the first color state, the second color state or an intermediate color state between the first and second color states.

In one embodiment, the first and second groups may be interchanged during updating of images. For example, for the first image, the first group of pixels are applied the WG waveform and the second group of pixels are applied the KG waveform and for the second image, the first group of pixels are applied the KG waveform and the second group of pixels are applied the WG waveform. In other words, the use of KG and WG waveforms may be alternating between the two groups of pixels.

Figure 5:
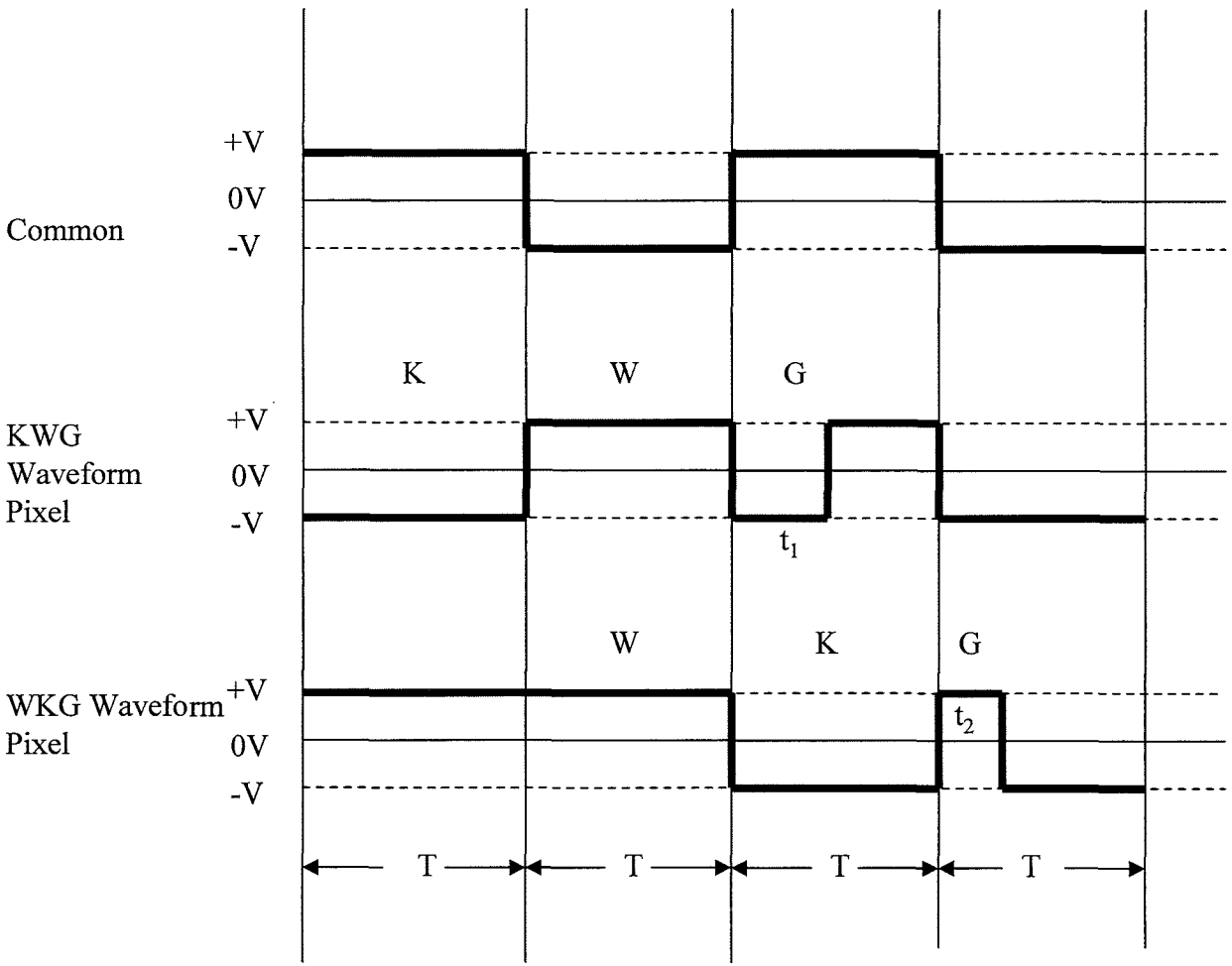
FIG. 5 shows alternative mono-polar driving waveforms.

FIG. 5 shows alternative mono-polar driving waveforms. As shown, there are two driving waveforms. In a method, a first group of the pixels are applied the WKG waveform and a second group of the pixels are applied the KWG waveform. In this example, the WKG waveform drive a pixel in the first group of pixels from its initial color state, to the full white state, then to the full black state and finally to a color state of a desired level. The KWG waveform, on the other hand, drives a pixel in the second group of pixels from its initial color state, to the full black state, then to the full white state and finally to a color state of a desired level.

The driving method as demonstrated in FIG. 5 may be generalized as follows:

A driving method for a display device having a binary color system comprising a first color and a second color, which method comprises a) applying waveform to drive each pixel in a first group of pixels from its initial color state to the full first color state, then to the full second color state and finally to a color state of a desired level; and b) applying waveform to drive each pixel in a second group of pixels from its initial color state to the full second color state, then to the full first color state and finally to a color state of a desired level.

Similarly, the first and second groups may be interchanged during updating of the images. For example, the two waveforms may be alternating between the two groups of pixels.

The two groups of pixels may be randomly scattered or arranged in a specific pattern. For example, the two groups of pixels may be arranged in a checker board manner as shown in FIG. 6, and in this case, the number of the pixels in the first group is substantially the same as the number of pixels in the second group. An evenly distributed spatial arrangement such as a checker board arrangement would give the closest image quality as if the display medium were un-degraded. Since the two waveforms cause opposite grey level shifts, the viewers' eyes will average the grey levels of two neighboring pixels and perceive grey levels which are very close to the desired grey levels. This embodiment of the invention is particularly suitable for a scenario in which the degradation of the speed for driving from a full first color state to a desired color state is substantially the same as the degradation of speed for driving from a full second state to a desired color state.

Alternatively, the numbers of pixels in the two groups may be determined by how the response speed has degraded. As shown in FIG. 4, the response speed degradation is more pronounced for the KG waveform than the WG waveform. For example, if the reflectance of the pixels driven from the white state to a grey state has increased by 1% and the reflectance of the pixels driven from the black state to a grey state has reduced by 2%, then the number of pixels driven by the WG waveform preferably is about double the number of pixels driven by the KG waveform. Therefore it is possible to statistically pre-calculate the degradation rates and assign different numbers of pixels to the WG or KG waveforms to achieve a balance of spatial densities of the pixels driven by two different waveforms.

Although some artifacts may be seen in the image driven by the method of the present invention, if the difference between the two images driven by the waveforms individually becomes significant, a major improvement in image quality would have achieved long before such artifacts become visible.

In the method as described, the number of the first group of pixels and the number of the second group of pixels may be added to 100% of the total pixels. However, in practice, it is possible that certain pixels are not driven and in this case, the two groups of pixels may not be added to 100%.

For the mono-polar driving methods as described above, the pixels are driven to their destined color states in separate phases. In other words, some areas are driven from a first color to a second color before the other areas are driven from the second color to the first color. For mono-polar driving, a waveform is applied to the common electrode.

For bi-polar applications, it is possible to update areas from a first color to a second color and also areas from the second color to the first color, at the same time. The bi-polar approach requires no modulation of the common electrode and the driving from one image to another image may be accomplished, as stated, in the same driving phase. For bi-polar driving, no waveform is applied to the common electrode.

It is shown in FIG. 3 that the mono-polar driving method of the present invention has three phases. As a result, the image change transition is smoother because during the first two phases, the images would be close to a full grey image due to spatially multiplexing of the black and white states. In addition, the driving time is also reduced because the method has only three driving phases.

The present method may also be run on a bi-polar driving scheme. The two bi-polar waveforms WG and KG are shown in FIG. 7*a* and FIG. 7*b*, respectively. The bi-polar driving method has only two phases. In addition, as the common electrode in a bi-polar driving method is maintained at ground, the WG and KG waveforms can run independently without being restricted to the shared common electrode.

In practice, the common electrode and the pixel electrodes are separately connected to two individual circuits and the two circuits in turn are connected to a display controller. The display controller issues signals to the circuits to apply appropriate voltages to the common and pixel electrodes respectively. More specifically, the display controller, based on the images to be displayed, selects appropriate waveforms and then issues signals, frame by frame, to the circuits to execute the waveforms by applying appropriate voltages to the common and pixel electrodes. The term "frame" represents timing resolution of a waveform.

The pixel electrodes may be a TFT (thin film transistor) backplane.

While the present invention has been described with reference to the specific embodiments thereof, it should be understood by those skilled in the art that various changes may be made and equivalents may be substituted without departing from the scope of the invention. In addition, many modifications may be made to adapt a particular situation, materials, compositions, processes, process step or steps, to the objective and scope of the present invention. All such modifications are intended to be within the scope of the claims appended hereto.

What is claimed is:

1. A driving method for a display device having a binary color system comprising a first color and a second color, which method comprises a) applying a first waveform to drive each pixel in a first group of pixels from its initial color state to the full first color then to a color state of a first desired level; and b) applying a second waveform to drive each pixel in a second group of pixels from its initial color state to the full second color then to a color state of a second desired level, wherein the numbers of the pixels in the first and second groups are determined based on speed degradation of driving from the first color state to a first intermediate color state and speed degradation of driving from the second color state to a second intermediate color state.

2. The method of claim 1, wherein the first and second colors are two contrasting colors.

3. The method of claim 2, wherein the two contrasting colors are black and white.

4. The method of claim 1, wherein both waveforms are mono-polar driving waveforms.

5. The method of claim 1, wherein both waveforms are bi-polar driving waveforms.

6. The method of claim 1, wherein the first and second groups of pixels are arranged in a random manner.

7. The method of claim 1, wherein the first and second groups of pixels are arranged in a regular pattern.

8. The method of claim 7, wherein the first and second groups of pixels are arranged in a checker board fashion.

9. The method of claim 1, wherein the first and second groups of pixels are interchanged during updating of images.

10. The method of claim 9, wherein the two waveforms are alternating between the two groups of pixels.

11. A driving method for a display device having a binary color system comprising a first color and a second color, which method comprises a) applying a first waveform to drive each pixel in a first group of pixels from its initial color state to the full first color state, then to the full second color state and finally to a color state of a first desired level; and b) applying a second waveform to drive each pixel in a second group of pixels from its initial color state to the full second color state, then to the full first color state and finally to a color state of a second desired level, wherein the numbers of the pixels in the first and second groups are determined based on speed degradation of driving from the first color state to a first intermediate color state and speed degradation of driving from the second color state to a second intermediate color state.

12. The method of claim 11, wherein said first color is black and said second color is white or vice versa.

13. The method of claim 11, wherein the first and second groups of pixels are interchanged during updating of images.

14. The method of claim 13, wherein the two waveforms are alternating between the two groups of pixels.

* * * * *